United States Patent [19]

VanDerHoeven

[11] Patent Number: 4,848,740

[45] Date of Patent: Jul. 18, 1989

[54] ABDOMINAL MUSCULATURE DEVELOPMENT DEVICE

[75] Inventor: Martin VanDerHoeven, Oceanside, Calif.

[73] Assignee: Rio-Flex Corp., Carlsbad, Calif.

[21] Appl. No.: 156,404

[22] Filed: Feb. 16, 1988

[51] Int. Cl.[4] ..... A63B 21/00

[52] U.S. Cl. ..... 272/134; 272/118; 272/145

[58] Field of Search ..... 272/72, 117, 118, 134, 272/136, 142, 145, 143

[56] References Cited

U.S. PATENT DOCUMENTS

| | | | |
|---|---|---|---|
| 232,022 | 9/1880 | Gifford | 272/134 X |
| 3,741,538 | 6/1973 | Lewis et al. | 272/134 |
| 4,290,597 | 9/1981 | Schleffendorf | 272/117 |
| 4,398,713 | 8/1983 | Ellis | 272/145 |
| 4,625,962 | 12/1986 | Street | 272/72 X |
| 4,637,608 | 1/1987 | Owens et al. | 272/134 |
| 4,653,750 | 3/1987 | McIntyre | 272/143 X |
| 4,666,151 | 5/1987 | Chillier | 272/118 X |
| 4,702,108 | 10/1987 | Amundsen et al. | 272/134 X |
| 4,725,055 | 2/1988 | Skowrowski | 272/134 |
| 4,725,056 | 2/1988 | Rehrl et al. | 272/134 |
| 4,725,057 | 2/1988 | Shifferaw | 272/134 X |

*Primary Examiner*—Richard J. Apley
*Assistant Examiner*—Robert W. Bahr
*Attorney, Agent, or Firm*—Charmasson & Holz

[57] ABSTRACT

A method of physical exercise is described utilizing a machine configured to support the user during exercise in a specific suspended position to immobilize and isolate certain muscle groups while exercising others. The method and device is particularly well suited and designed for exercise of the abdominal musculature, but is conveniently adaptable for exercise of other muscle groups and design of unique exercise methods utilizing short restricted movements culminating in a isometrically tensioned exercise position.

5 Claims, 4 Drawing Sheets

ABDOMINAL MUSCULATURE DEVELOPMENT DEVICE

FIELD OF THE INVENTION

This invention relates to the increasingly popular field of body development and exercise activity for the purpose of increasing tone, size and definition of musculature. With increasing emphasis on fitness in American life, development of new forms of exercise and exercise machines have accelerated rapidly, most notable in the famous line of Nautilus cam-operated exercise machines. Other examples of full range-of-motion pulley-weight exercise machines found in the prior art Schleffendorf U.S. Pat. No. 4,290,597 Physical Exercise Apparatus; Anderson U.S. Pat. No. 3,558,130, Exercising Device Using Pendulum Weight and Pulley; Anderson U.S. Pat. No. 4,616,825 Aerobic Exercise Machine. Each of the devices suffers, however, from lack of ability to isolate and exercise only a specified muscle group, although, some declare muscle isolation as a desirable objective. The full range-of-motion embodied in these devices necessarily exercises multiple muscle groups and the muscle which is desired to be developed will not receive the full benefit of the exercise workout unless it can be so isolated.

Full motion exercises, as well as many other common weightlifting and machine-oriented exercise methods, may also contribute to imbalance of muscular development. Because muscle groups are exercised together, the relative development of on muscle within the group, or of one group within several groups in proximity, cannot be specifically enabled. A particularly difficult problem which has been addressed in several machine oriented exercise methods, is development of the abdominal musculature. Because these muscles, especially the transverse abdominus group, are not attached to a skeletal joint which can be flexed in order to exercise attached muscles, motion-oriented exercise is not effective to work the abdominal group because the motion centers around the moving joints involved in the exercise such as hip flexors. Therefore the full effort of the abdominal workout is dispersed to other muscles around the joints, and the workout is not focused on the desired musculature. Further, the flexors may overdevelop to the point that less and less of the workout load is carried by the abdominals, further decreasing the desired effect.

The traditional exercise to develop abdominals is a common sit-up, an example of a full range-of-motion exercise. But sit-ups are singularly ineffective for the desired purpose, and it is well-known that many hours and years of repetitions are necessary to produce any effect at on abdominal musculature definition. Some machines which take as their objective development of the abdominal musculature are merely weight-loaded sit-ups, and similarly ineffective. Another difficulty in effectively exercising abdominal musculature is that the frontal abdominal muscle groups are tied, directly or indirectly, to the spinal erector muscles groups and, ideally, balanced against those counter-poised muscle groups in the back. This points to another difficulty with sit-up-style exercises, and especially weight-loaded exercises, that ignore the related muscle groups in the back and exacerbate back problems by excessive spinal movement, imbalance of fore-and-aft spinal forces, and possibly vertebral dislocation.

It is an objective of the within device not only to effectively exercise and develop the abdominal musculature, but to do so in a way that does not require large spinal movement or unduly load the spine or the spinal erector group with imbalanced forces that will cause orthopedic problems.

SUMMARY OF THE INVENTION

The within invention as an exercise methodology is developed to define an ending exercise position that will suitable balance the user's entire body and focus the exercise effort upon an isolated desired muscle group. Specifically the methodology and the machine developed to enable practice of the methodology are here focused on the abdominal musculature, but can be adapted for exercises focusing on other isolated muscle groups as well. Tensioning devices of traditional weight-and-pulley style or spring-force style are provided, but are positioned to require only a short range of motion before the desired tensioned isometric position is reached and held immobile for a period of time by the user. In the balanced, tensioned position, the user will realize maximum effect on the isolated muscle group, in the principal illustrated case, the transverse abdominus.

A uniquely constructed exercise machine is defined to enable the practice of the exercise methodology, and to hold the user's body in a specifically suspended and tensioned position whereby all exerted forces are directed toward and balanced at the abdominal musculature.

Thus the principal object of the invention is to provide an exercise method that will isolate and exercise a specific muscle group.

Another object of the invention is to define a specific end position for an exercise which will suspend, tension and balance the user's body to maximum effect on a specific isolated muscle group.

Another object of the invention is to provide an apparatus which will enable practice of the exercise methodology.

Another object of the invention is to provide a specific apparatus to maximize efficiency of exercise of the abdominal musculature.

Another object of the invention is to provide an exercise machine that is adaptable to various exercises of both the isolated muscle exercise variety defined herein, and ordinary weight-loading exercise and training exercises.

DESCRIPTION OF THE PREFERRED EMBODIMENT OF THE INVENTION

Figure 1:
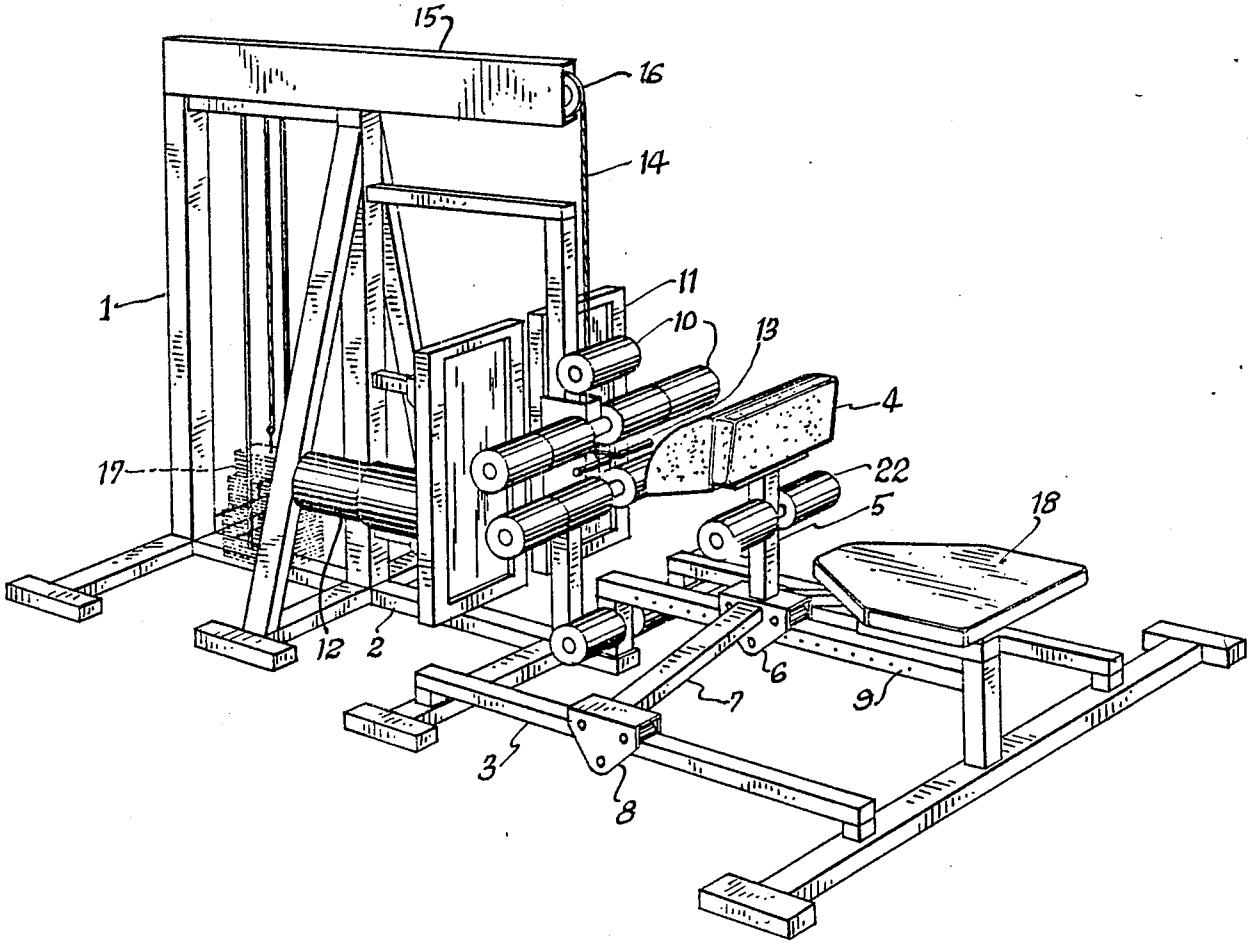
FIG. 1 is a perspective view of the abdominal exercise machine on which the unique exercise methodology may be practiced.

Referring now to the drawings, there are shown various views of the invention and its parts which will illustrate attainment of the objectives specified above.

The perspective view of FIG. 1 illustrates the exercise exercises for development of specific muscle groups. The frame 1 is supported by footings 2 in a wide supporting structure which further supports horizontal members 3. Exercise seat 4 is provided to support the user in a specific exercise position which will be later defined, and is in turn supported by seat post 5 which rests on seat bearing 6, slidably supported and arranged on seat bearing 6, girder 7 and buttress bearing 8, which rests upon the horizontal supports. Other aids to restraining the user in the specifically defined exercise position are the ankle restraining blocks 10, in proximity to the foot push plates 11 which are in turn integrally connected to tensioning pistons 12 of spring, pneumatic, or hydraulic operation.

Figure 2:
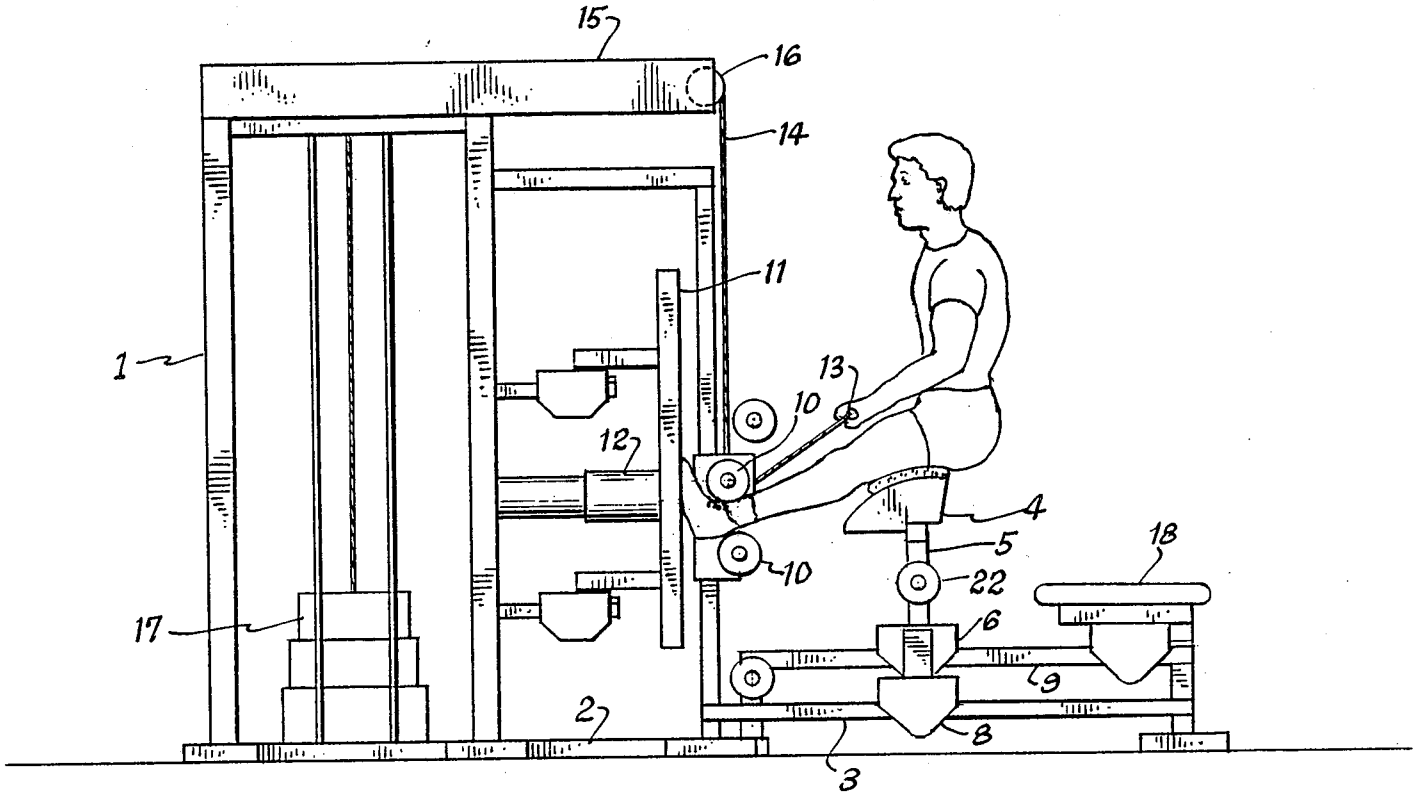
FIG. 2 is a side view of the exercise machine with a human subject shown in the basic suspended position during exercise.

The operative weight loading mechanism is embodied in curl handles 13 consisting of a bar with two hand grips of standard configuration, attached at its center to weight cable 14, which is engaged around pulley frame 15 and various pulleys, typically 16, all of which are operatively connected to weight stack 17. Thus in operation as shown in FIG. 2, the exercise subject is supported in the basic exercise position. The seat is adjusted both in height and in horizontal separation from the footplate to accommodate the user's individual physical dimensions. The seat supports the user in position approximately under the thighs, with the user's center of gravity positioned rearward of the seat support. The legs are extended and the user pushes against the tensioning footplate to provide a balancing force first against the contracting force against the curl handle which will be described shortly, and second against the lever arm force of the user's center of gravity acting downward aft of the fulcrum provided by the seat against the thighs. The user now pulls against the curl handle which is attached by pulley arrangement to the weight stack and the weight stack is loaded according to the user's ability. As can be seen, only a short range of motion is required to pull the user's hands toward him into a position approximately with the elbows at his side. In this position all four forces acting on his body are in balance and tension is required to maintain this position by pushing on the footplate and pulling on the curl handle. It has been calculated that all of these forces will center on the transverse abdominus group in this position. As can also be seen, all of the muscle groups centering around skeletal joints, such as the hip flexors and the knee, elbow and shoulder joints, have been either immobilized in the tensioning exercise or move only through a very short range of motion. Therefore a great part of the effort required to maintain the tensioning position must be exerted through the now isolated abdominal muscles, greatly enhancing efficiency of exercise of those muscles. Further this balanced position will require corresponding tensioning of the spinal erector muscles, in order to maintain a balanced erect position, and the opposing or erecting forces of the abdominals against the spinal erectors will develop in proportionally balanced fashion to the orthopedic benefit of the user.

Figure 3:
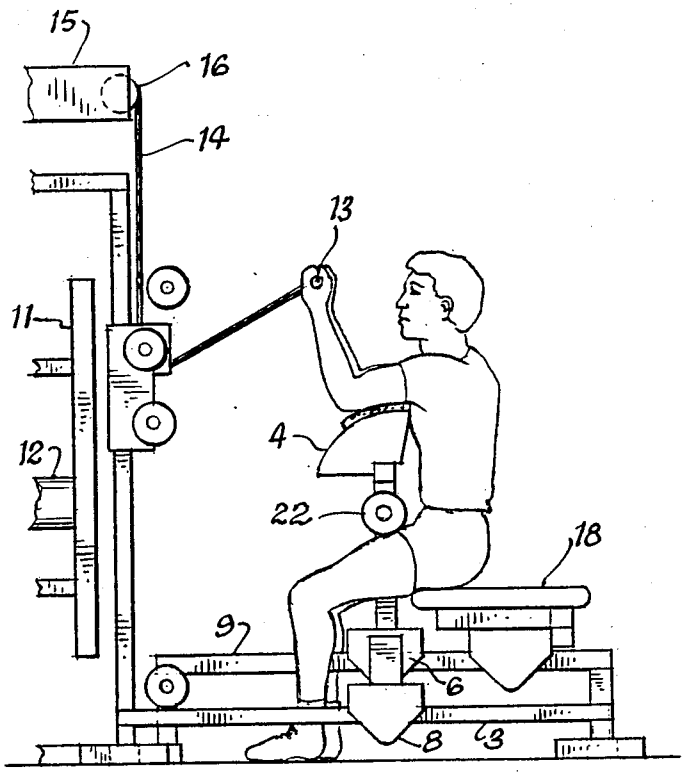
FIG. 3 is a side view of the abdominal exercise machine with the human subject in a secondary arm-curl exercise position.

Shown on FIG. 1 in the last itemized detail is secondary exercise seat 18, which may now be seen in operation on FIG. 3. FIG. 3 shows in side view a portion of the exercise machine and the user placed on the secondary seat 18, positioned for an arm curl exercise which will be seen to also increase efficiency of bicep workout by immobilizing other muscle groups in proximity. The curl handle 13 and weight cable 14 have been repositioned on other available pulleys, typically 16, to accommodate the arm curl exercise, and the exercise seat 4 has been adjusted forwardly to fit now under the user's armpits, and the user's lower body is immobilized by placement of thigh blocks 30 consisting of a padded roller type device over the top of the thighs.

In standard arm curl exercise fashion, the user works the bicep muscle by weight loaded exercise of pulling up the arm curl bar and rotating the forearms upward, and reversing the exercise to lower and extend the muscle slowly. Other muscle groups are isolated from the exercise because the entire upper body and lower body is immobilized by placement of the subject in seated position with the exercise seat 4 under the armpits, and only very small movement of the shoulder muscles is possible the majority of the exercise force is now concentrated on the biceps and forearms, the intended development object of this exercise. This is in contrast to free weight arm curls or traditional exercise machine arm curls in which there are many opportunities for upper body movement which detracts from exercise efficiency.

Figure 4:
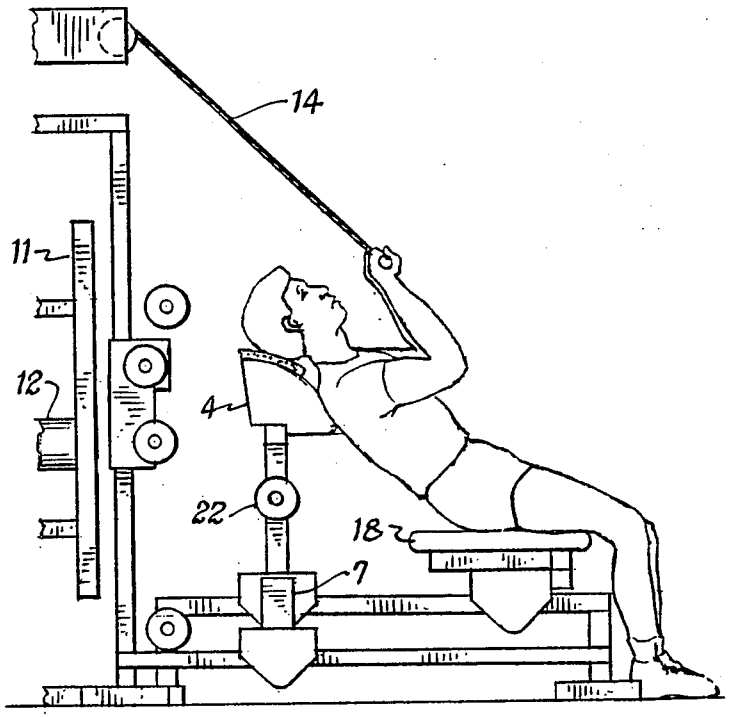
FIG. 4 is a side view of the abdominal exercise machine with the subject in a tertiary exercise position.

Similarly FIG. 4 shows in rearranged position, particularly with aftward rotation of exercise seat 4 to provide now a shoulder and head rest, and rearward adjustment of secondary exercise seat 18. The user is engaged in an exercise corresponding to a traditional lat pull which, having similarly immobilized other muscle groups surrounding skeletal joints, will concentrate the force of the exercise in the desired muscle group in the back and shoulders, and illustrating the diversity of arrangement of the exercise machine as designed.

Figure 5:
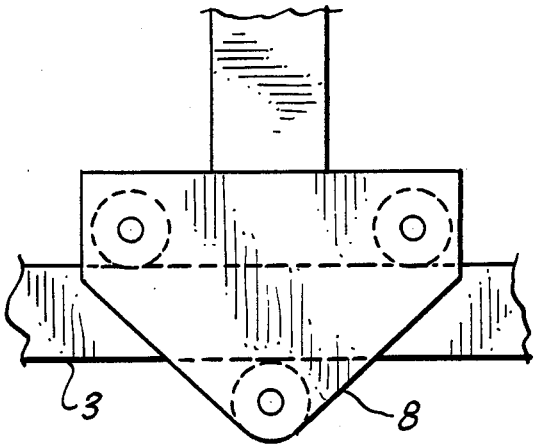
FIG. 5 is a detail of the roller-support bearing for the seat-adjustment mechanism of the machine;.

FIG. 5 shows a detail of the roller support bearing and its carriage on the horizontal supports, which are necessary to easily adjust the structures of the exercise device for a variety of exercise, but still retain the compression strength and rigidity necessary to a durable arrangement of components.

Figure 6:
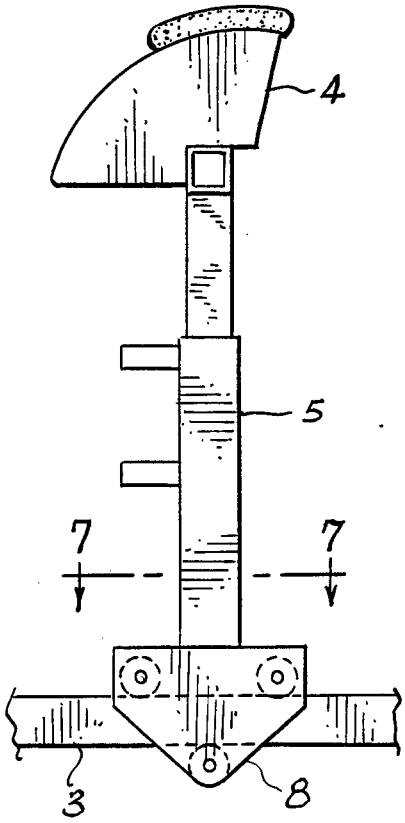
FIG. 6 is a detail of seat-support and bearing.
Figure 7:
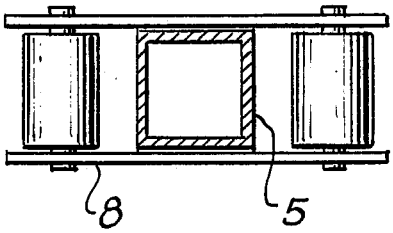
FIG. 7 is a further sectioned detail of the roller bearing.

FIGS. 6 and 7 are shown in enabling detail for the adjustment and rigid support after adjustment of the seat support and bearing in FIG. 6 and further of the roller bearing in FIG. 7.

I claim:

1. A multi-use apparatus for exercising various muscular systems in a subject's body which comprises:

a force generating device comprising a force-generator, a handle, a cable joining said handle to said force-generator, a plurality of pulleys guiding said cable through a plurality of directions; and a framework mounting said pulleys;

a first support of said subject adjustably fixed in a position distal from said framework, said support comprising a first cushion member and a vertical leg mounting said first cushion member above ground to an overall height between 90 centimeters and 120 centimeters;

a horizontal anklebar on said framework, said anklebar being capable of resisting forces exerted by said subject's foot in a direction generally perpendicular to the bottom of said subject's foot, and said anklebar positioned above ground to a lower height than said first cushion support, wherein said force generating device, said anklebar, said first cushion member and said leg are shaped and dimensioned to immobilize said subject while said subject is tensing the abdominal portion of said muscular systems; and wherein the first of said pulleys which is proximate to said handle and said first pulley is generally located in the same horizontal plane as said anklebar and immediately above it.

2. The apparatus of claim 1 which further comprise a resilient pushplate mounted vertically within said framework and behind said anklebar in relation to said first support.

3. The apparatus claimed in claim 1, wherein said force generator comprise at least a weight hanging from the end of said cable opposite the end associated with said handle.

4. The apparatus of claim 2, wherein said pushplate comprises a resilient force-generator applied horizontally against said plate and biased toward said first support.

5. The apparatus as claimed in claim 4 wherein said force generating device, said anklebar, said first cushion member and said leg are shaped and dimensioned to support and position said subject's center of gravity outboard from a vertical plane containing said cushion member.

* * * * *